US011439213B2

(12) United States Patent
Kyung

(10) Patent No.: US 11,439,213 B2
(45) Date of Patent: Sep. 13, 2022

(54) WALLET-TYPE PORTABLE UMBRELLA

(71) Applicant: Min Soo Kyung, Seoul (KR)

(72) Inventor: Min Soo Kyung, Seoul (KR)

( * ) Notice: Subject to any disclaimer, the term of this patent is extended or adjusted under 35 U.S.C. 154(b) by 0 days.

(21) Appl. No.: 17/601,346

(22) PCT Filed: Aug. 11, 2020

(86) PCT No.: PCT/KR2020/010631
§ 371 (c)(1),
(2) Date: Oct. 4, 2021

(87) PCT Pub. No.: WO2021/049769
PCT Pub. Date: Mar. 18, 2021

(65) Prior Publication Data

US 2022/0095755 A1 Mar. 31, 2022

(30) Foreign Application Priority Data

Sep. 11, 2019 (KR) ..... 20-2019-0003768
Dec. 30, 2019 (KR) ..... 20-2019-0005351
Apr. 8, 2020 (KR) ..... 20-2020-0001215

(51) Int. Cl.

| | |
|---|---|
| ***A45B 25/24*** | (2006.01) |
| ***A45B 19/06*** | (2006.01) |
| ***A45B 19/10*** | (2006.01) |
| ***A45B 25/02*** | (2006.01) |
| *A45B 9/02* | (2006.01) |

(52) U.S. Cl.
CPC ..... *A45B 25/24* (2013.01); *A45B 19/06* (2013.01); *A45B 19/10* (2013.01); *A45B 25/02* (2013.01); *A45B 9/02* (2013.01)

(58) Field of Classification Search
CPC ..... A45B 25/24
See application file for complete search history.

(56) References Cited

U.S. PATENT DOCUMENTS 2,468,240 A * 4/1949 Schmidt ..... A45B 25/24 135/34.2
3,896,866 A 7/1975 Hoffman
5,427,346 A * 6/1995 Urgola ..... A45C 9/00 248/910

(Continued)

FOREIGN PATENT DOCUMENTS

JP 3036927 U 5/1997
JP 3227074 U 8/2020

(Continued)

OTHER PUBLICATIONS

International Search Report for PCT/KR2020/010631 dated Nov. 13, 2020 [PCT/ISA/210].

(Continued)

*Primary Examiner* — David R Dunn
*Assistant Examiner* — Danielle Jackson
(74) *Attorney, Agent, or Firm* — Sughrue Mion, PLLC

(57) ABSTRACT

The present invention may provide a wallet-type portable umbrella comprising: an umbrella including a grip portion; a case including a storage portion which includes a storage space in which the umbrella is accommodated, and a cover portion which can be fastened to the grip portion and opens and closes the storage portion; and a coupling unit for fastening the grip portion and the cover portion.

5 Claims, 10 Drawing Sheets

(56) References Cited

U.S. PATENT DOCUMENTS

| | | | | |
|---|---|---|---|---|
| 9,055,794 | B1 | 6/2015 | Gorouvein et al. | |
| 2005/0098199 | A1 | 5/2005 | Ko | |
| 2005/0166949 | A1* | 8/2005 | Ko | A45B 9/02 135/25.41 |
| 2008/0236641 | A1* | 10/2008 | Carson | A45B 9/02 135/34.2 |

FOREIGN PATENT DOCUMENTS

| | | | |
|---|---|---|---|
| KR | 200438289 | Y1 * | 2/2008 |
| KR | 10-2013-0102986 | A | 9/2013 |

OTHER PUBLICATIONS

Written Opinion for PCT/KR2020/010631 dated Nov. 13, 2020 [PCT/ISA/237].

* cited by examiner

WALLET-TYPE PORTABLE UMBRELLA

CROSS-REFERENCE TO RELATED APPLICATIONS

This application is a National Stage of International Application No. PCT/KR2020/010631 filed Aug. 11, 2020, which claims priority based on Korean Patent Application No. 20-2019-0003768 filed on Sep. 11, 2019, Korean Patent Application No. 20-2019-0005351 filed on Dec. 30, 2019, Korean Patent Application No. 20-2020-0001215 filed on Apr. 8, 2020, the entire disclosures of which are incorporated herein by reference.

TECHNICAL FIELD

The present invention relates to a hyperportable wallet-type umbrella having a compact size overall and a small thickness to be carriable in a pocket.

BACKGROUND ART

Generally, an umbrella refers to an item used to prevent clothes or a body from being wet when it rains or snows. In general, rain or snow is prevented from coming into direct contact with a human using fabric supported by a plurality of ribs and rain drops are allowed to fall outside an umbrella due to ribs being formed to be curved.

A conventional foldable umbrella includes an umbrella cover formed of fabric into which a folded umbrella is insertable. Since the umbrella cover is separated from the umbrella when the umbrella is used, a user binds the cover with an upper portion of an umbrella handle, that is, a certain portion of a pole functioning as a support as a storage system thereof. In this case, it is inconvenient to manage the umbrella cover, and the umbrella cover may be easily lost and not be aesthetically pleasing.

Also, the conventional foldable umbrella is portable while being placed in a bag having an intermediate size or larger but is not accommodated in a mini-bag or a pouch-shaped bag such that it is not easy to carry the conventional foldable umbrella. In addition, in the case of a user who does not carry a bag, there is inconvenience of holding the conventional foldable umbrella in a hand.

DISCLOSURE

Technical Problem

The present invention is directed to providing a wallet-type portable umbrella including a compact and slim wallet-type case carried while being placed in a pocket so as to easily carry the umbrella.

The present invention is also directed to providing a wallet-type portable umbrella in which a cover of a case is usable as a grip portion of the umbrella so as to prevent the cover from being lost and to easily carry the umbrella.

The present invention is also directed to providing a wallet-type portable umbrella which is compact so as to be easily carried and accommodated while umbrella ribs have a variable length so as to increase a size of the umbrella which is unfolded.

Technical Solution

One aspect of the present invention provides a wallet-type portable umbrella including an umbrella including a grip portion, a case including an accommodation portion including an accommodation space in which the umbrella is accommodated and a cover portion is fastenable to the grip portion and configured to open or close the accommodation portion, and a coupling unit configured to fasten the grip portion and the cover portion.

While the cover portion is separated from the accommodation portion and then the cover portion is disposed to be perpendicular to a longitudinal direction of the umbrella, the cover portion may be wound around the grip portion.

The coupling unit may include a magnet portion fixed to the grip portion or a part of the cover portion which faces the grip portion and a detaching groove formed at a part of the cover portion or the grip portion, in which the magnet portion is not installed, to face the magnet portion while being formed to allow the magnet portion to be insertable thereinto so as to generate a magnetic force with the magnet portion.

The coupling unit may include an insertion portion fixed to the grip portion and including wing portions protruding from top and bottom ends in a direction of facing each other and a block portion fixed to a part of the cover portion which faces the insertion portion and including sliding grooves into which the wing portions are slidably inserted.

The umbrella may include umbrella ribs each including a first bar connected to an umbrella ferrule and a second bar pivotably connected to the first bar and extending outward, spring portions each installed on a certain length of the first bar, and spreaders each having a top end connected to an outer end of the first bar and a bottom end connected to an umbrella shaft.

The umbrella may include umbrella ribs each including a first bar connected to an umbrella ferrule and a second bar pivotably connected to the first bar and extending outward, cylinder portions each installed on an outer end of the first bar to allow the first bar to be insertable thereinto or withdrawable therefrom, and spreaders each having a top end connected to the cylinder portion and a bottom end connected to an umbrella shaft.

Advantageous Effects

According to embodiments of the present invention, a compact and slim wallet-type case carried while placed in a pocket is included so as to easily carry the umbrella.

Also, a cover of a case is allowed to be used as a grip portion of an umbrella so as to prevent the cover from being lost and to easily carry the umbrella.

Also, the umbrella may have a compact size so as to be easily carried and accommodated while umbrella ribs have a variable length so as to increase a size of the umbrella which is unfolded.

BEST MODE OF THE INVENTION

Hereinafter, detailed embodiments of the present invention will be described with reference to the accompanying drawings. However, these are merely examples and the present invention is not limited thereto.

In describing the present invention, when it is determined that a detailed description of known techniques associated with the present invention would unnecessarily obscure the subject matter of the present invention, the detailed description thereof will be omitted. Also, the terms used herein are defined in consideration of the functions of the present invention and may be changed depending on a user, the intent of an operator, or a custom. Accordingly, the terms should be defined based on the following overall description of this specification.

The technical concept of the present invention will be determined by the claims, and the following embodiments are merely means for efficiently describing the technical concept of the present invention to one of ordinary skill in the art.

Figure 1:
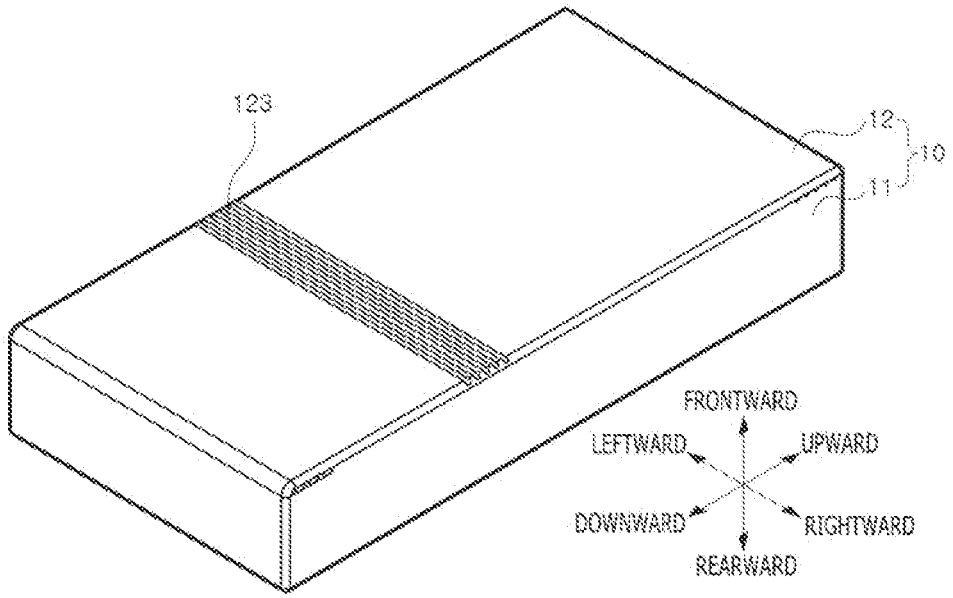
FIGS. 1 and 2 are views illustrating a wallet-type portable umbrella according to one embodiment of the present invention.
Figure 2:
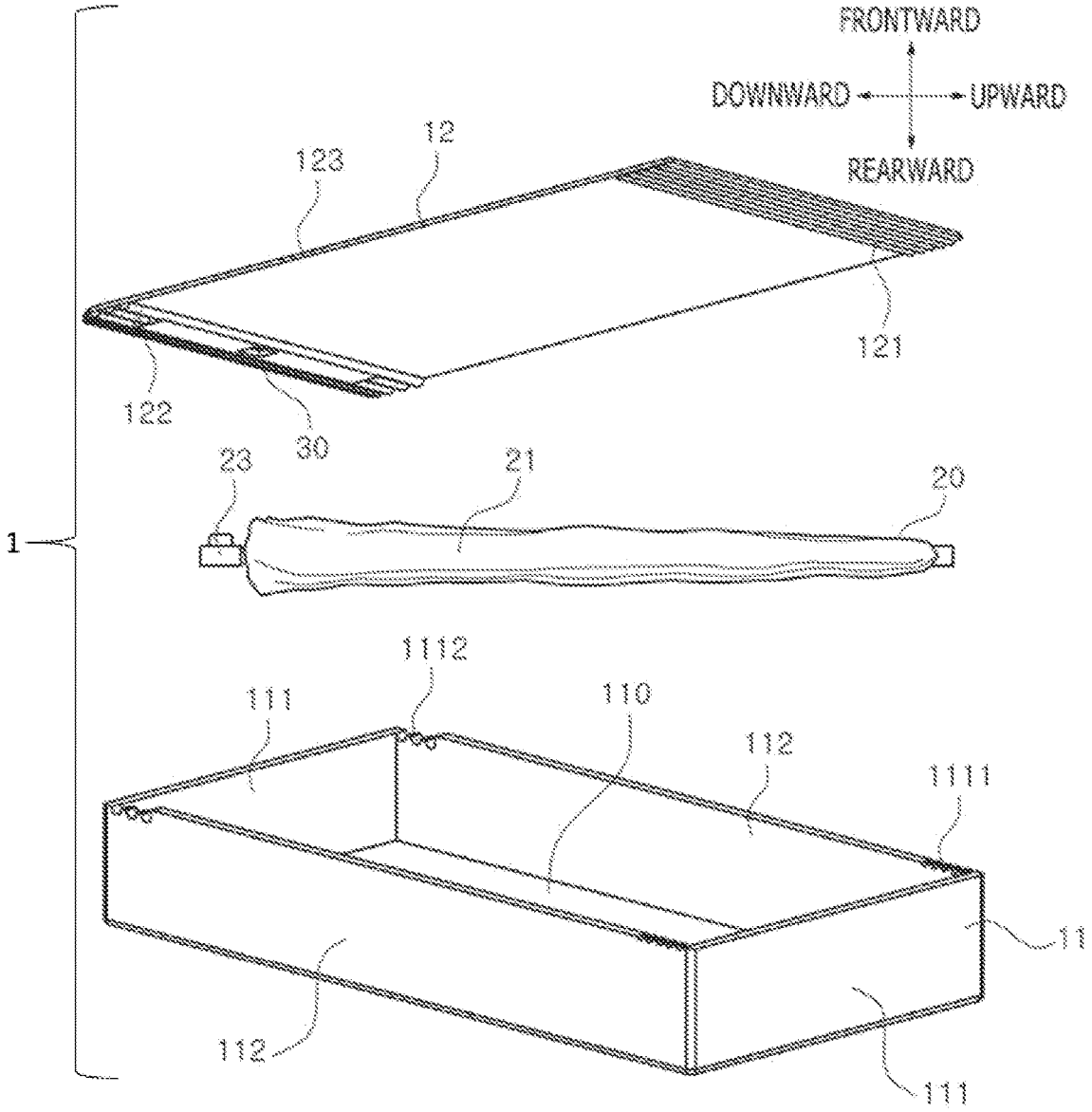
Figure 3:
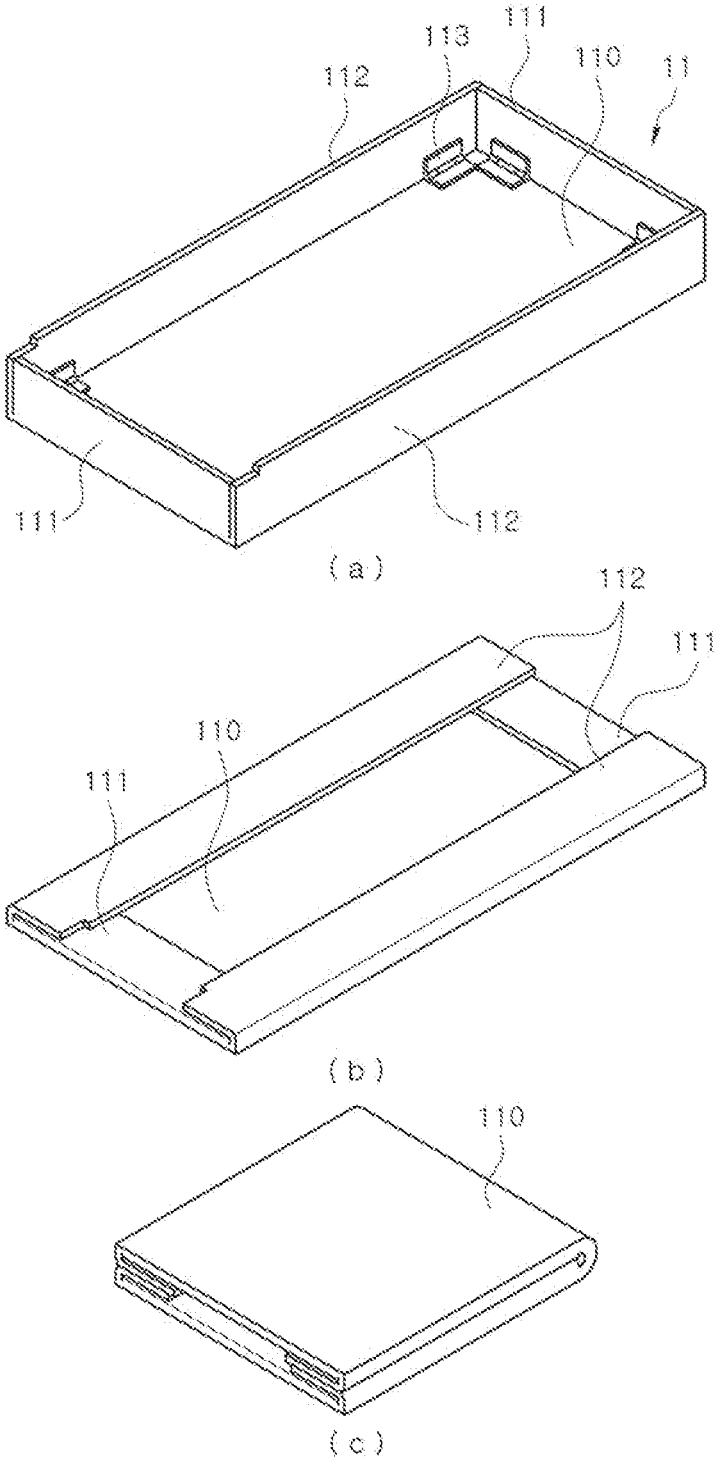
FIG. 3 shows illustrating an accommodation portion according to one embodiment of the present invention.
Figure 4:
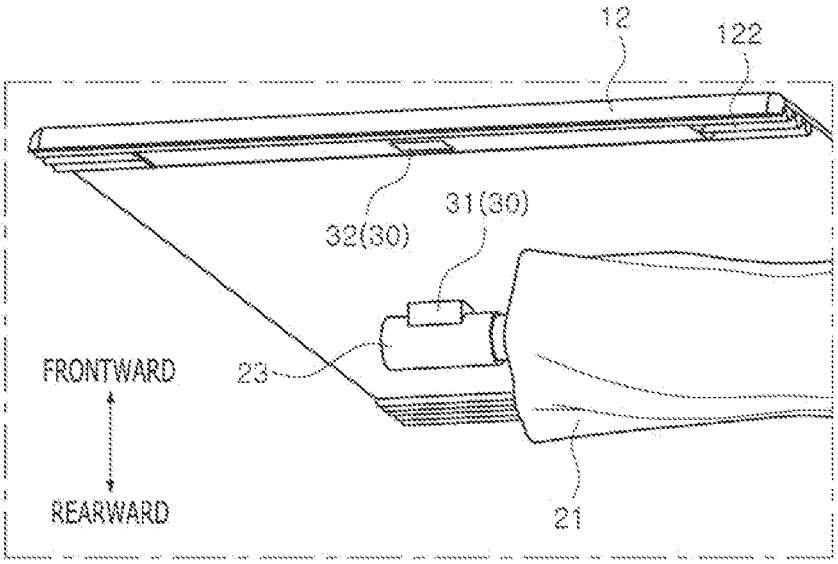
FIG. 4 is a view illustrating a coupling unit according to one embodiment of the present invention.
Figure 5:
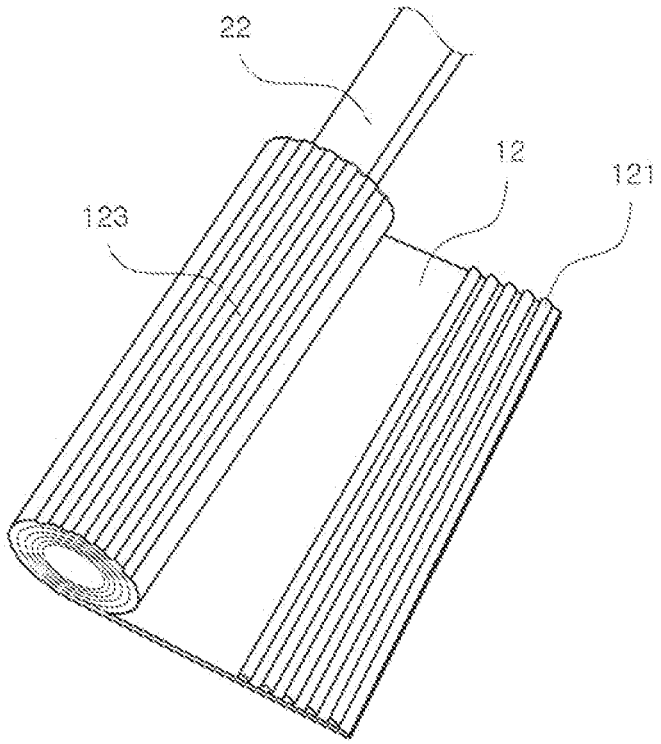
FIG. 5 is a view illustrating a cover portion wound on a grip portion according to one embodiment of the present invention.

FIGS. 1 and 2 are views illustrating a wallet-type portable umbrella according to one embodiment of the present invention, (a) to (c) of FIG. 3 are views illustrating an accommodation portion according to one embodiment of the present invention, FIG. 4 is a view illustrating a coupling unit according to one embodiment of the present invention, and FIG. 5 is a view illustrating a cover portion wound on a grip portion according to one embodiment of the present invention.

Referring to FIGS. 1 to 5, a wallet-type portable umbrella 1 may include a case 10, an umbrella 20, and a coupling unit 30.

The case 10 may accommodate the umbrella (parasol) 20. The case 10 may be formed to include an accommodation space configured to accommodate the umbrella 20. As an example, the case 10 may be formed to have a rectangular parallelepiped shape.

The case 10 may include an accommodation portion 11 and a cover portion 12.

The accommodation portion 11 may be formed to have a rectangular parallelepiped shape including an internal space capable of accommodating the umbrella 20 therein and with an open front. The accommodation portion 11 may be formed to have a compact size and thickness to be placed in a pocket. Accordingly, when the umbrella 20 is used, the accommodation portion 11 may be accommodated in the pocket.

The accommodation portion 11 may include a bottom portion 110, a first wall portion 111, and a second wall portion 112.

The bottom portion 110 may form a bottom surface and support the umbrella 20 accommodated in the internal space. The bottom portion 110 may be formed as a rectangular shape.

The first wall portion 111 may be connected to each of sides of the bottom portion 110 facing each other so as to form a sidewall. As an example, the first wall portion 111 may be a sidewall connected to a shorter side of the bottom portion 110.

The second wall portion 112 may be connected to each of sides of the bottom portion 110 facing each other and may be connected between the first wall portions 111 on both sides. As an example, the second wall portion 112 may be a sidewall connected to a longer side of the bottom portion 110.

The accommodation portion 11 may be manufactured using a material such as urethane, rubber, latex, silicone, plastic, and the like which is light but capable of maintaining a shape so as to have a certain level of rigidity.

Here, referring to (a) to (c) of FIG. 3, the accommodation portion 11 may be formed to be foldable.

(a) of FIG. 3 is a view illustrating a state before the accommodation portion 11 is folded, (b) of FIG. 3 is a view illustrating a state in which the first wall portion 111 and the second wall portion 112 of the accommodation portion 11 are folded, and (c) of FIG. 3 is a view illustrating a state in which the bottom portion 110 of the accommodation portion 11 is folded.

While the umbrella 20 and the cover portion 12 are separated from the accommodation portion 11, the accommodation portion 11 may be folded and easily accommodated in the pocket. Here, the accommodation portion 11 may be formed of a material such as urethane, rubber, latex, silicone, plastic, and the like which is to light but capable of maintaining a shape and foldable by an external force.

When the accommodation portion 11 is formed to be foldable as shown in (a) to (c) of FIG. 3, the accommodation portion 11 may further include a hinge 113. Each of the first wall portion 111 and the second wall portion 112 is connected to the bottom portion 110 by the hinge 113 while the first wall portion 111 and the second wall portion 112 may be connected to be pivotable toward the internal space.

When the accommodation portion 11 is folded as shown in (b) of FIG. 3, the first wall portion 111 connected by the hinge 113 may be pivoted toward the internal space to be level with the bottom portion 110. Subsequently, the second wall portion 112 may be pivoted toward the internal space to be level with the bottom portion 110 above the first wall portion 111. In this state, as shown in (c) of FIG. 3, a central portion may be folded half along a longitudinal direction of the bottom portion 110. As described above, the accommodation portion 11 may be folded and accommodated in the pocket.

In the present invention, it has been described as an example that the first wall portion 111 and the first wall portion 112 are pivoted by the hinges 113 and are folded in the internal space. However, the present invention is not limited thereto. Also, a shape of the hinge 113 shown in (a) of FIG. 3 is merely provided an example and the hinge 113 may be formed to have a variety of shapes.

As an example, the first wall portion 111 and the second wall portion 112 may be separated from the bottom portion 110. The first wall portion 111, the second wall portion 112, and the bottom portion 110 may be formed of a material having a mutual magnetic force. The first wall portion 111, the second wall portion 112, and the bottom portion 110 may be fixed to one another due to the magnetic force. The first wall portion 111, the second wall portion 112, and the bottom portion 110, which are separated from one another, are arranged and fixed as shown in (b) of FIG. 3 and then the bottom portion 110 may be folded.

The accommodation portion 11 may include a fastening groove 1111 and a fastening protrusion 1112.

The fastening groove 1111 may be formed in an upper portion of a front surface of the accommodation portion 11. In detail, the fastening groove 1111 may be formed by spacing a plurality of grooves apart in a vertical direction in an upper portion of a front surface of the second wall portion 112. The fastening groove 1111 may be formed at a position facing a coupling protrusion 121 formed in an upper portion of a rear surface of the cover portion 12. As an example, the fastening groove 1111 may be a semicircular or quadrangular groove.

The fastening protrusion 1112 may be formed in a lower portion of the front surface of the accommodation portion 11. In detail, the fastening protrusion 1112 may be formed by spacing a plurality of protrusions apart in a vertical direction in a lower portion of the front surface of the second wall portion 112. Here, the fastening protrusion 1112 may be formed at a position facing a coupling groove 122 formed in a lower portion of the rear surface of the cover portion 12.

The cover portion 12 may be fastened to or separated from the accommodation portion 11 to cover or open the open front surface of the accommodation portion 11. Also, the cover portion 12 may be connected to the umbrella 20 by the coupling unit 30 to be fastened thereto.

While the cover portion 12 is fastened to the umbrella 20, the cover portion 12 may be fastened to the accommodation portion 11 when the umbrella 20 is accommodated in the accommodation portion 11 and the cover portion 12 may be separated from the accommodation portion 11 when the umbrella 20 is withdrawn from the accommodation portion 11.

The cover portion 12 may be formed of a flexible material such as urethane, rubber, latex, silicone, and the like. A lower portion of the cover portion 12 formed of a soft material as described above may be rotatably fastened to a grip portion 23 of the umbrella 20. After the cover portion 12 is separated from the accommodation portion 11, while the cover portion 12 has been rotated to be perpendicular to a longitudinal direction of the umbrella 20, the cover portion 12 may be wound on the grip portion 23. When the cover portion 12 is wound on the grip portion 23, an area of the grip portion 23 increases so that a grippable region may be increased. Accordingly, a better feel of grip may be provided.

The cover portion 12 may include the coupling protrusion 121, the coupling groove 122, and a fixing groove 123.

The coupling protrusion 121 may be formed in the upper portion of the rear surface of the cover portion 12. That is, the coupling protrusion 121 may be formed at a position facing the fastening groove 1111. The coupling protrusion 121 may be formed to protrude with a shape corresponding to the fastening groove 1111 from the upper portion of the rear surface of the cover portion 12.

As the coupling protrusion 121 is inserted into the fastening groove 1111, the cover portion 12 may be fastened to the accommodation portion 11. As the coupling protrusion 121 is detached from the fastening groove 1111, the cover portion 12 may be separated from the accommodation portion 11.

The coupling groove 122 may be formed in the lower portion of the rear surface of the cover portion 12. That is, the coupling groove 122 may be formed at a position facing the fastening protrusion 1112 and have a shape into which the fastening protrusion 1112 is insertable.

As the fastening protrusion 1112 is inserted into the coupling groove 122, the cover portion 12 may be fastened to the accommodation portion 11. As the fastening protrusion 1112 is detached from the coupling groove 122, the cover portion 12 may be separated from the accommodation portion 11.

The fixing groove 123 may be formed in a part of the front surface of the cover portion 12. The fixing groove 123 may be formed at a part of the front surface of the cover portion 12 while having a groove shape into which the coupling protrusion 121 formed in the upper portion of the rear surface of the cover portion 12 is insertable.

As shown in FIG. 5, when the cover portion 12 is wound on the grip portion 23 while the cover portion 12 has been rotated perpendicularly to the longitudinal direction of the umbrella 20, the coupling protrusion 121 may be inserted into the fixing groove 123 to fix a wound state.

However, although it has been described that the fixing groove 123 and the coupling protrusion 121 are fastened using a protrusion and groove shape, the present invention is not limited thereto and the fixing groove 123 and the coupling protrusion 121 may be fastened using a fixable member such as VELCRO®, a magnet, or the like.

The umbrella 20 may include an umbrella canopy 21 and the grip portion 23.

The umbrella canopy 21 may be fabric supported by umbrella ribs 25 to prevent rain and snow. Also, the umbrella canopy 21 may be elastic spandex fabric.

The grip portion 23 may be a part formed at a bottom end of an umbrella shaft 22 to be gripped by a user. The grip portion 23 may have a cylindrical shape and be wound along a cylindrical shape of the grip portion 23 when the cover portion 12 is wound.

The cover portion 12 may be rotatably fastened to the grip portion 23 by a coupling unit 30.

The coupling unit 30 may detachably fasten the grip portion 23 and the cover portion 12. The coupling unit 30 may include a magnet portion 31 and a detaching groove 32.

The magnet portion 31 may be fixed to any one of the grip portion 23 and a part of the cover portion 12 which faces and is fastened to the grip portion 23.

The detaching groove 32 may be formed at another of the cover portion 12 and the grip portion 23 where the magnet portion 31 is not installed to face the magnet portion 31. The detaching groove 32 may be formed to allow the magnet portion 31 to be insertable thereinto. Here, an inside of the detaching groove 32 may be formed of a material such as metal and the like which generates a magnetic force with the magnet portion 31. The magnet portion 31 may be inserted into the detaching groove 32 and fixed by a magnetic force so as to fix the grip portion 23 and the cover 12.

In the present invention, it will be described as an example that the magnet portion 31 is formed on the grip portion 23 and the detaching groove 32 is formed in the cover portion 12.

Hereinafter, a method of using the above-described wallet-type portable umbrella 1 will be described.

As shown in FIG. 1, when the umbrella 20 is intended to be used because it is raining or snowing while the umbrella 20 is accommodated in the case 10, the cover portion 12 may be separated from the accommodation portion 11 so as to detach the umbrella 20 from the accommodation portion 11. While the cover portion 12 and the umbrella 20 are separated from the accommodation portion 11 and then disposed so that longitudinal directions of the cover portion 12 and the umbrella 20 are perpendicular to each other, the magnet portion 31 may be inserted into and fixed to the detaching groove 32.

Subsequently, while the umbrella shaft 22 is elongated lengthwise, the cover portion 12 may be wound on the grip portion 23 as shown in FIG. 5. When the cover portion 12 is wound on the grip portion 23 from a bottom thereof and completely wound, the coupling protrusion 121 formed in the upper portion of the rear surface of the cover portion 12 may be inserted into the fixing groove 123 formed in part on an intermediate portion of the front surface of the cover portion 12 so as to fix a wound state of the cover portion 12.

As described above, the cover portion 12 may be wound on the grip portion 23 of the umbrella 20 so as not to be lost and to provide the umbrella 20 with improved feel of grip, and the accommodation portion 11 may be folded and accommodated in the pocket not to be lost.

Figure 6:
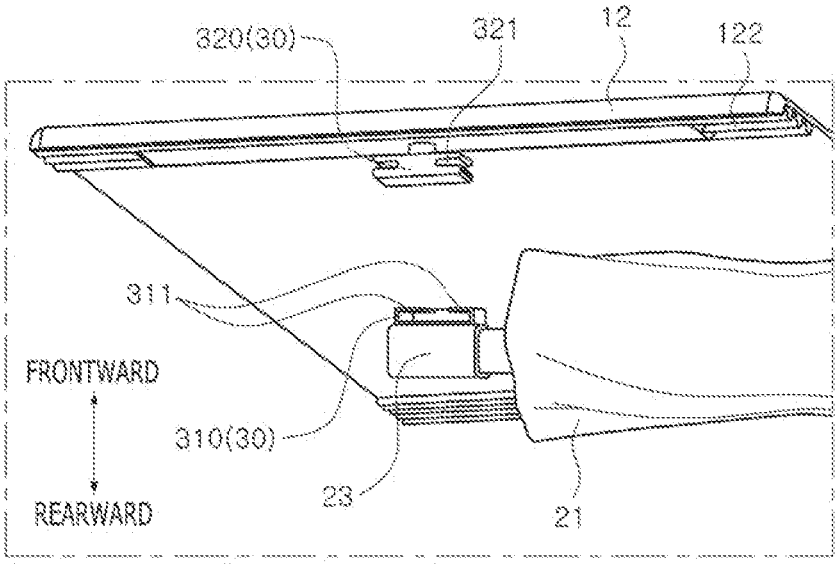
FIG. 6 is a view illustrating a coupling unit according to another embodiment of the present invention.

FIG. 6 is a view illustrating a coupling unit according to another embodiment of the present invention.

Referring to FIG. 6, the wallet-type portable umbrella 1 may include the case 10, the umbrella 20, and the coupling unit 30. Hereinafter, only the coupling unit 30 which is a component different from that shown in FIGS. 1 to 4 will be described. A description of the same components other than that will be omitted.

The coupling unit 30 may include an insertion portion 310 and a block portion 320.

The insertion portion 310 may be fixed to a front surface of the grip portion 23. The insertion portion 310 may include wing portions 311 which are formed to have an L-shape and are bent and protrude in a direction of facing each other. In detail, the wing portion 311 formed in a lower portion of the insertion portion 310 may protrude forward and be bent upward, and the wing portion 311 formed in an upper portion of the insertion portion 310 may protrude forward and be bent downward so as to face each other.

The insertion portion 310 may be formed of plastic.

The block portion 320 may be fixed to a part of the cover portion 12 which faces the insertion portion 310 and may include sliding grooves 321 in an upper portion and a lower portion to allow the wing portions 311 to be slidably insertable. The block portion 320 may be formed of plastic.

The wing portions 311 are slidably inserted into the sliding grooves 321 of the block portion 320 so that the block portion 320 and the insertion portion 310 may be fixed.

Figure 7:
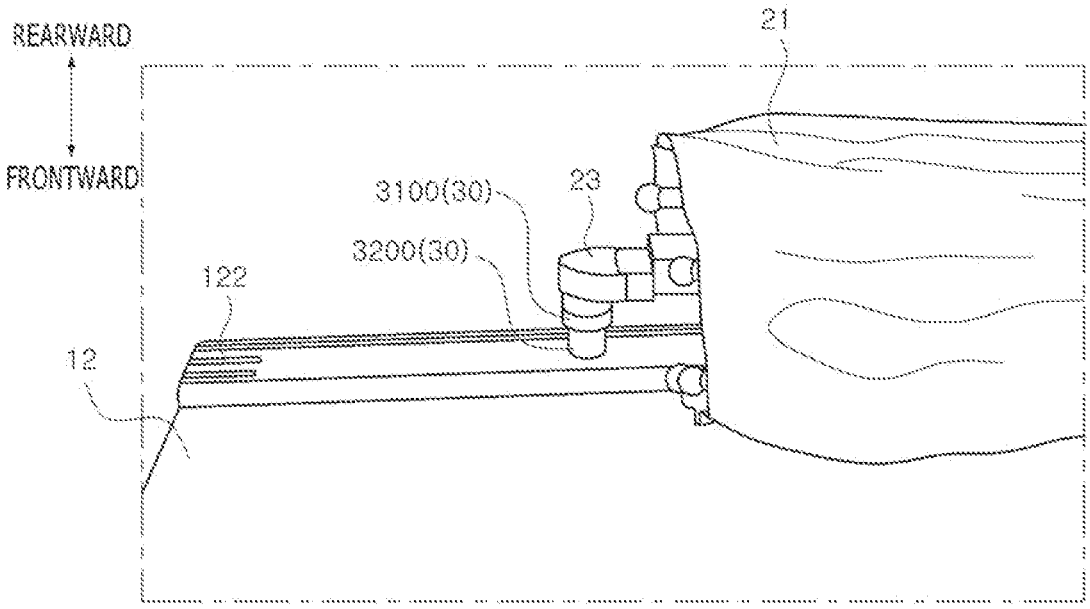
FIG. 7 is a view illustrating a coupling unit according to still another embodiment of the present invention.

FIG. 7 is a view illustrating a coupling unit according to still another embodiment of the present invention.

Referring to FIG. 7, the wallet-type portable umbrella 1 may include the case 10, the umbrella 20, and the coupling unit 30. Hereinafter, only the coupling unit 30 which is a component different from that shown in FIGS. 1 to 4 will be described. A description of the same components other than that will be omitted.

The coupling unit 30 may include a fixing shaft 3100 and a rotating shaft 3200.

The fixing shaft 3100 may be fixed to the grip portion 23 and protrude forward.

The rotating shaft 3200 may be fixed to a part of the cover portion 12 which faces the fixing shaft 3100 and may protrude toward the fixing shaft 3100. The rotating shaft 3200 may be rotatably connected to the fixing shaft 3100.

As described above, since the rotating shaft 3200 fixed to the cover portion 12 is rotatably connected to the fixing shaft 3100 fixed to the grip portion 23, the cover portion 12 may be rotatably connected to the grip portion 23 of the umbrella 20.

Accordingly, when the umbrella 20 is used, the cover portion 12 may be rotated to be perpendicular to the grip portion 23 through the rotating shaft 3200 and then wound on the grip portion 23.

Figure 8:
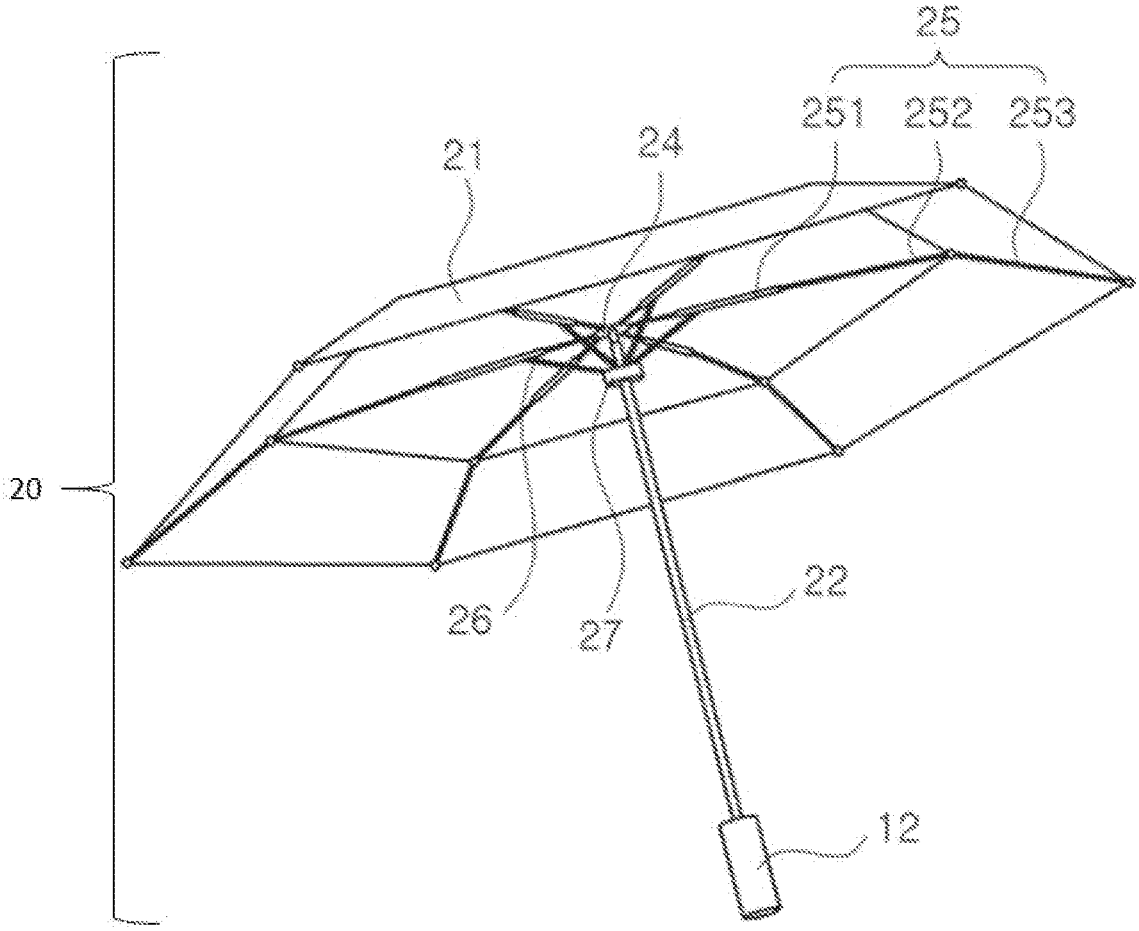
FIG. 8 is a view illustrating an umbrella according to one embodiment of the present invention.
Figure 9:
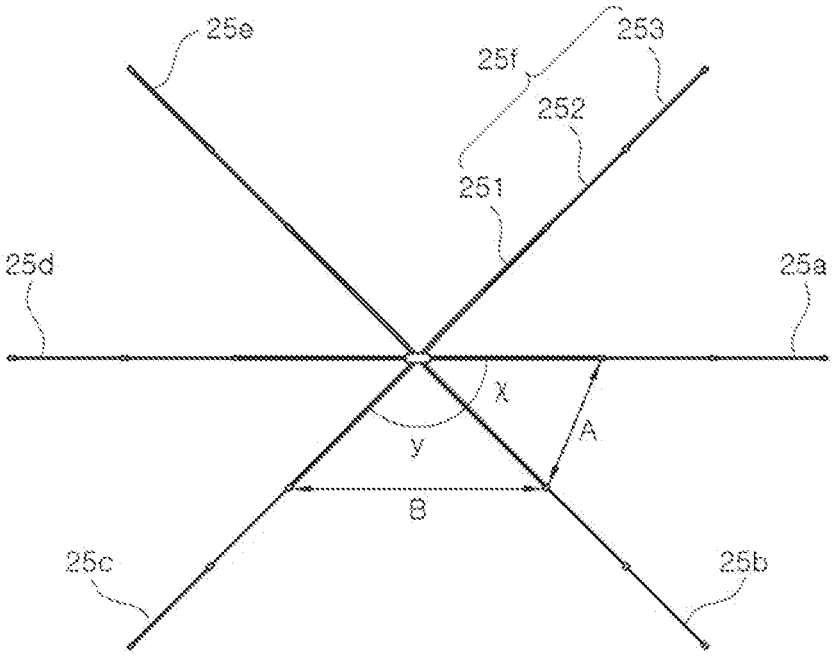
FIG. 9 is a view illustrating arrangement of umbrella ribs of the umbrella according to one embodiment of the present invention.
Figure 10:
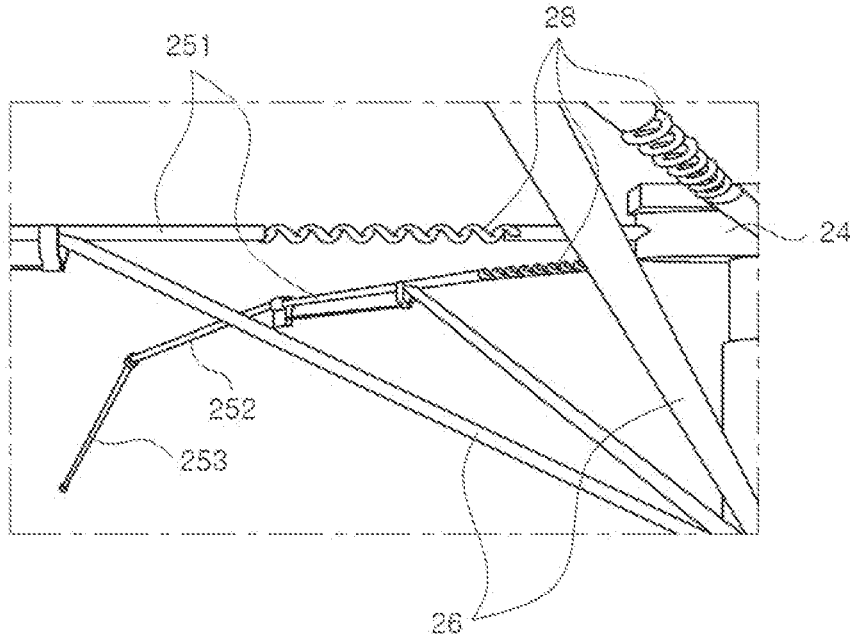
FIG. 10 is an enlarged view illustrating the umbrella rib including a spring portion according to one embodiment of the present invention.

FIG. 8 is a view illustrating the umbrella according to one embodiment of the present invention, FIG. 9 is a view illustrating arrangement of the umbrella ribs of the umbrella according to one embodiment of the present invention, and FIG. 10 is an enlarged view illustrating the umbrella rib including a spring portion according to one embodiment of the present invention.

Referring to FIGS. 8 to 10, the umbrella 20 may include the umbrella canopy 21, the umbrella shaft 22, the grip portion 23, an umbrella ferrule 24, the umbrella ribs 25, a spreader 26, and a spring portion 28. The umbrella 20 according to the present invention is the umbrella 20 called a flat umbrella and may be the umbrella 20 including a thin and flat umbrella shaft having a rectangular cross-section. The umbrella 20 including the flat umbrella shaft may be folded to be thinner than a folded umbrella including a cylindrical umbrella shaft.

The umbrella canopy 21 may be supported by the umbrella ribs 25 and block rain and snow. The umbrella canopy 21 may be formed of water-repellent spandex fabric such as a tarpaulin.

The umbrella shaft 22 is a long stand forming a center of the umbrella 20. The umbrella shaft 22 of the flat umbrella may be formed to have a small thickness and a rectangular cross-section instead of a cylindrical shape.

The grip portion 23 is a part formed at the bottom end of the umbrella shaft 22 to be gripped by a user.

The umbrella ferrule 24 is a center formed at a top of the umbrella shaft 22 and to which a plurality of such umbrella ribs 25 are fixed. The umbrella ferrule 24 of the flat umbrella may be formed to have a long rectangular shape having a narrow width instead of a circular shape to decrease a thickness of the folded umbrella.

The plurality of umbrella ribs 25 may be connected to the umbrella ferrule 24.

In the case of the umbrella 20 including a cylindrical umbrella shaft, generally, the plurality of umbrella ribs 25 are arranged while being spaced at the same intervals apart. However, in the case of the flat umbrella used in the present invention, the umbrella ribs 25 adjacent to the umbrella ribs 25 parallel to the umbrella ferrule 24 are arranged at smaller interval.

In detail, the umbrella ribs 25 may include a first umbrella rib 25*a*, a second umbrella rib 25*b*, a third umbrella rib 25*c*, a fourth umbrella rib 25*d*, a fifth umbrella rib 25*e*, and a sixth umbrella rib 25*f*.

Here, the first umbrella rib 25*a* and the fourth umbrella rib 25*d* may be parallel to the umbrella ferrule 24 and arranged to be symmetrical to each other on the basis of the umbrella ferrule 24.

The second umbrella rib 25*b* may be connected to the umbrella ferrule 24 to be spaced at an angel x apart from the first umbrella rib 25*a*, and the fifth umbrella rib 25*e* may be disposed to be symmetrical to the second umbrella rib 25*b*.

The third umbrella rib 25*c* may be connected to the umbrella ferrule 24 to be spaced at an angel y greater than the angle x apart from the second umbrella rib 25*b*, and the sixth umbrella rib 25*f* may be disposed to be symmetrical to the third umbrella rib 25*c*.

In summary, the first umbrella rib 25*a* and the second umbrella rib 25*b* are spaced at the angle x apart from each other, and the second umbrella rib 25*b* and the third umbrella rib 25*c* are spaced at the angle y greater than the angle x apart from each other. In other words, a distance A between the first umbrella rib 25*a* and the second umbrella rib 25*b* is shorter than a distance B between the second umbrella rib 25*b* and the third umbrella rib 25*c*.

Each of the umbrella ribs 25 may include a first bar 251, a second bar 252, and a third bar 253. In the embodiment, although a three-tiered umbrella including three bars will be described as an example, since the number of ribs may be determined according to a two-tiered umbrella 20, a three-tiered umbrella 20, a four-tiered umbrella 20, a five-tiered umbrella 20, and the like, a variety of numbers of ribs are available.

The first bar 251 may be connected to the umbrella ferrule 24, the second bar 252 may be pivotably connected to the first bar 251 and extend outward, and the third bar 253 may be pivotably connected to the second bar 252 and extend outward.

The spreader 26 may include one end connected to the umbrella rib 25 and the other end connected to the umbrella shaft 22.

In detail, the other end of the spreader 26 may be fixed to a runner 27 fastened to the umbrella shaft 22 to be vertically movable and may move along the umbrella shaft 22 according to movement of the runner 27.

When the other end of the spreader 26 moves to an upper portion of the umbrella shaft 22 according to upward movement of the runner 27, the one end of the spreader 26, which is connected to the first bar 251, pushes the first bar 251 outward so as to spread the umbrella 20. On the other hand, when the other end of the spreader 26 moves toward a lower portion of the umbrella shaft 22 according to downward movement of the runner 27, the one end of the spreader 26, which is connected to the first bar 251, pulls the first bar 251 inward so as to fold the umbrella 20.

Referring to FIG. 8, the spreader 26 may be connected to an outer end of the first bar 251.

The spring portion 28 may be installed on a certain length of the first bar 251. Since the spring portion 28 is installed on the first bar 251, a length of the first bar 251 may extend.

In detail, the spreader 26 is fixed to the outer end of the first bar 251 rather than the spring portion 28. The spring portion 28 may remain in a compressed state before the umbrella 20 is unfolded and may expand and increase a size of the umbrella 20 when the umbrella 20 is unfolded.

In this state, when the other end of the spreader 26 moves to the upper portion of the umbrella shaft 22 and the one end is pushed in an outward direction, the umbrella 20 may be unfolded and the spring portion 28 installed on the first bar 251 may expand. Since the length of the first bar 251 is extendable by the spring portion 28, the umbrella 20 may be a large size when used and may be a compact size when accommodated. In other words, the umbrella 20 which is compact when folded may increase in size in use as the length of the first bar 251 increases due to expansion of the spring portion 28.

Since it is necessary that the umbrella canopy 21 increases as an overall size of the unfolded umbrella is increased by the spring portion 28, the umbrella canopy 21 may be formed of elastic water-repellent spandex fabric.

Figure 11:
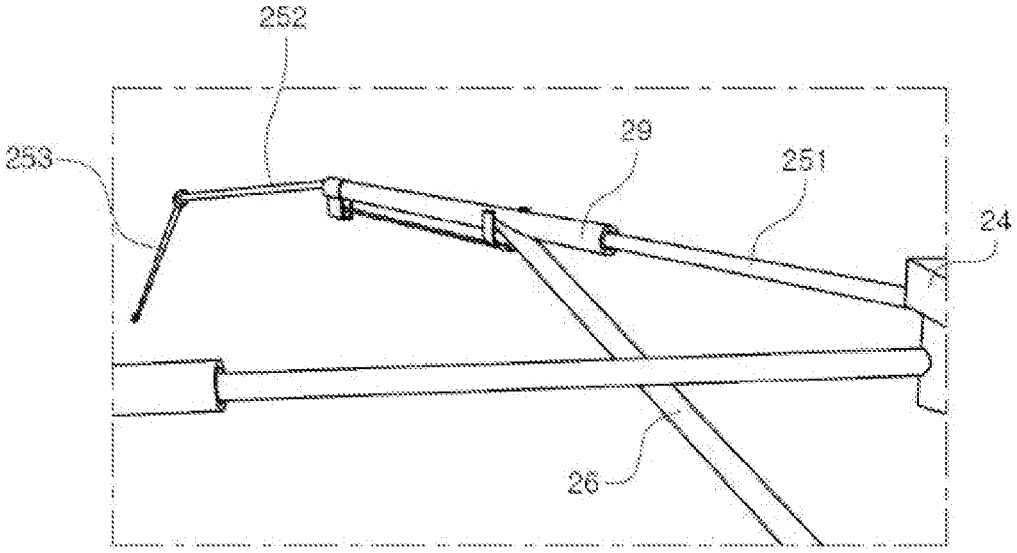
FIG. 11 is an enlarged view illustrating the umbrella rib including a cylinder portion according to one embodiment of the present invention.

FIG. 11 is an enlarged view illustrating the umbrella rib including a cylinder portion according to one embodiment of the present invention.

Referring to FIG. 11, the umbrella 20 may include the umbrella canopy 21, the umbrella shaft 22, the grip portion 23, the umbrella ferrule 24, the umbrella ribs 25, the spreader 26, and a cylinder portion 29. That is, referring to FIGS. 8 to 10, the spring portion 28 may be replaced with the cylinder portion 29. Hereinafter, only the cylinder portion 29 which is different from the components shown in FIGS. 8 to 10 will be described. A description of the same components other than that will be omitted.

The cylinder portion 29 may be installed on the outer end of the first bar 251 while the first bar 251 is insertable into or withdrawable from the cylinder portion 29. In this case, the spreader 26 may be connected to the cylinder portion 29.

In detail, the first bar 251 may be inserted into the cylinder portion 29 before the umbrella 20 is unfolded and the cylinder portion 29 may be moved outward and the first bar 251 may be withdrawn outward from the cylinder portion 29 when the umbrella 20 is unfolded.

When the other end of the spreader 26 moves upward and the one end is pushed outward, the cylinder portion 29 to which the one end of the spreader 26 is connected may move outward and the first bar 251 may be withdrawn from the cylinder portion 29. As described above, since the cylinder portion 29 is installed on the first bar 251, an extended length of the first bar 251 may be increased.

Accordingly, the umbrella 20 which has a compact size when folded may increase in the size in use as the length of the first bar 251 is extended by the cylinder portion 29.

Although the representative embodiments of the present invention have been described above in detail, it will be apparent to one of ordinary skill in the art to which the present invention belongs that a variety of modifications may be made without departing from the scope of the present invention. Therefore, the present invention is not limited to the above-described embodiments and should be defined by the following claims and equivalents thereof.

Modes of the Invention

The modes of the invention have been described above in the best mode of the present invention.

INDUSTRIAL APPLICABILITY

The present invention relates to a wallet-type portable umbrella which is manufactured to be a compact and slim size to be easily carried so as to be industrially applicable.

The invention claimed is:

1. A portable umbrella comprising:

an umbrella comprising a grip portion;

a case comprising (i) an accommodation portion comprising an accommodation space in which the umbrella is accommodated and (ii) a cover portion which is fastenable to the grip portion and configured to open or close the accommodation portion; and a coupling unit configured to fasten the grip portion and the cover portion, wherein when the cover portion is separated from the accommodation portion and then disposed perpendicular to a longitudinal direction of the umbrella, the cover portion is wound on the grip portion.

2. The portable umbrella of claim 1, wherein the coupling unit comprises:

a magnet portion fixed to the grip portion or a part of the cover portion which faces the grip portion; and a detaching groove formed in one of the cover portion or the grip portion, in which the magnet portion is not installed, to face the magnet portion, wherein the detaching groove is formed to allow the magnet portion to be insertable thereinto so as to generate a magnetic force with the magnet portion.

3. The portable umbrella of claim 1, wherein the coupling unit comprises:

an insertion portion fixed to the grip portion and comprising wing portions protruding from top and bottom ends in a direction of facing each other; and a block portion fixed to a part of the cover portion which faces the insertion portion and comprising sliding grooves into which the wing portions are slidably inserted.

4. The portable umbrella of claim 1, wherein the umbrella comprises:

umbrella ribs each comprising a first bar connected to an umbrella ferrule and a second bar pivotably connected to the first bar and extending outward;

spring portions each installed on a certain length of the respective first bar; and spreaders each having a top end connected to an outer end of the respective first bar and a bottom end connected to an umbrella shaft.

5. The portable umbrella of claim 1, wherein the umbrella comprises:

umbrella ribs each comprising a first bar connected to an umbrella ferrule and a second bar pivotably connected to the first bar and extending outward;

cylinder portions each installed on an outer end of the respective first bar to allow the respective first bar to be insertable thereinto or withdrawable therefrom; and spreaders each having a top end connected to the respective cylinder portion and a bottom end connected to an umbrella shaft.

* * * * *